United States Patent [19]

Tarbox

[11] 3,930,524

[45] Jan. 6, 1976

[54] HARNESS MAKING APPARATUS

[76] Inventor: John W. Tarbox, 12936 Caminito de las Olas, Del Mar, Calif. 92014

[22] Filed: Oct. 17, 1974

[21] Appl. No.: 515,481

[52] U.S. Cl. ..... 140/93 R; 29/203 MW
[51] Int. Cl.[2] ..... B21F 27/00
[58] Field of Search .... 140/92.1, 93 R; 29/203 MW

[56] References Cited

UNITED STATES PATENTS

| | | | |
|---|---|---|---|
| 3,144,053 | 8/1964 | Felts, Sr. | 140/93 |
| 3,693,228 | 9/1972 | Logan | 29/203 |

*Primary Examiner*—Lowell A. Larson
*Attorney, Agent, or Firm*—John W. Tarbox

[57] ABSTRACT

An apparatus for the orderly dispensing of wire to form a harness, comprising a strand pay out head which is moved by an automated control unit in two dimensions over a layout table having strategically positioned pegs and wire gripping elements thereon such that the wire is engaged in one of the gripping elements, entrained around certain of the pegs, secured in another of the gripping elements and cut, the entire process being performed repeatedly and automatically to lay all of the wires of the particular harness in the required configuration. The wire pay out head has a swivel mounted feed unit which receives wire from a continuous source and ordinarily the end of the wire projects slightly from the feed and is automatically retained by any of the gripping elements upon the passage therethrough of the feed unit, subsequent to which a knife on the pay out device cuts the wire if such is required for the harness being made.

12 Claims, 16 Drawing Figures

HARNESS MAKING APPARATUS

BACKGROUND OF THE INVENTION

The invention relates to strand dispensing systems and particularly to systems designed to lay wires in a predetermined order for a wire harness.

Wiring harnesses are used in most electrical appliances and electronic equipment items, as well as vehicles, boats, and aircraft. Of the enormous number of harnesses made, the great majority are assembled completely or partially by hand. Automated machinery has been developed for this purpose, as exemplified by U.S. Pats. No. 3,699,630 and 3,804,130, although the number of machines of all types actually being used is minuscule. The units disclosed in the above referenced patents function adequately but are susceptible to several operational problems, the most important relating to the fact that the individual lengths of wire are cut at a point well away from the actual point of dispensation, which results in somewhat inexact lengths being produced due to wire curl, and a feed mechanism to introduce the new wire into the feed head is required.

SUMMARY OF THE INVENTION

The present harness making assembly utilizes a dispensing head which cooperates with wire gripping combs on a layout board such that the passage of the head through any one of the combs results in the secure capture of the wire comb without any special movement on the part of the dispensing head. Control of the unit is completely automated and a knife on the dispensing head is used to sever the wire on the layout board itself so that accuracy of length of each segment, in the harness environment, is assured regardless of wire curl. The dispensing head is also provided with a catch near the knife to prevent reverse travel of the wire in the head after each cut.

The specialized wire gripping combs which are used are resilient and provided with several parallel slots through which the dispensing head passes at different times in the process, and during a pass the comb grips the wire and retains it as the dispensing head moves on. Without relaxing their grip on the wires the combs may be removed from the layout board either to become a permanent part of the harness or to maintain the wires in the proper order until final installation.

To accomodate different wire sizes, a bank of dispensing heads is provided, each being supplied with a different size or type of wire, from which the translatory mechanism selects according to the control program so that numerous different wire types can be incorporated automatically in a single wiring harness without requiring an attendant to change heads.

DETAILED DESCRIPTION OF THE PREFERRED EMBODIMENT

Figure 6:
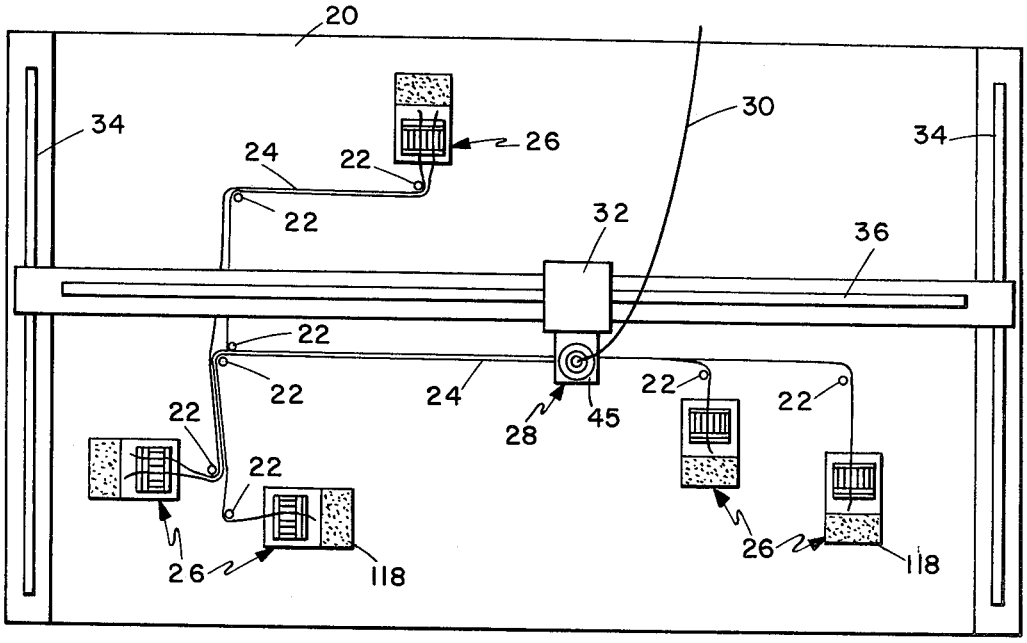
FIG. 6 is a top plan view of a typical X-Y table on which the device is used to lay out a wire harness.
Figure 7:
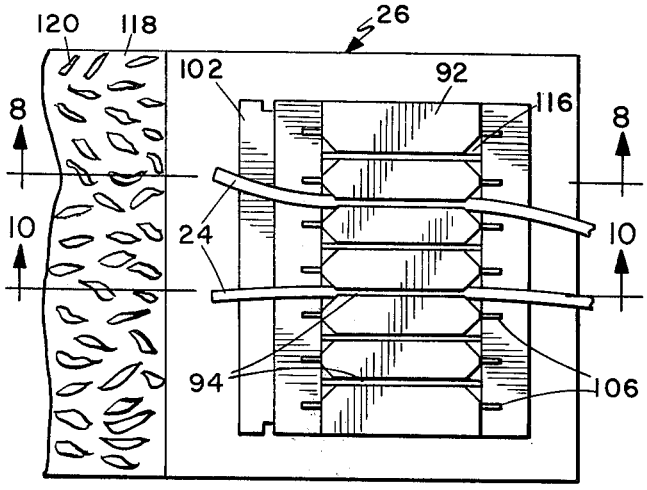
FIG. 7 is an enlarged top plan view of a wire end holding unit.

The general arrangement of the harness making assembly is best illustrated in FIG. 6, wherein a layout board 20 is provided with pegs 22 at the branching positions of individual wires 24 of the wiring harness, and various locations on the board representing terminal stations of the wires have comb-like wire gripping elements 26 mounted thereto. The apparatus for dispensing the wire comprises a dispensing head 28 which receives wire 30 from a continuous supply, which is not shown, and a translatory device 32 which rides on rails 34 and 36 and carries the dispensing head over the entire board according to intelligence input received from a control unit. The details of the translatory device are artitrary, within certain limits discussed hereinafter, and the device is illustrated very diagrammatically. In general terms, the dispensing head is moved from a wire-gripping comb in which the wire is secured, around one or more pegs (or no pegs at all) and through another comb which engages the wire, subsequent to which the wire may be cut by a mechanism on the dispensing head or left intact, and another sweep is made to lay another wire segment and so forth until the entire harness is laid and can be tied and removed.

The wire dispensing head 28 comprises two basic parts, a base member 38 and a guide member 40 which is mounted on the base member and rotatable thereon about the vertical axis. The larger upper portion of the base member is provided with a conical depression 42 in the top and has a depending hollow shaft 44 mounted thereto immediately below the concial section such that a continuous vertical passageway is provided for the wire 30 from the supply spool.

It is intended that a number of dispensing heads be used in a single harness making apparatus, each being threaded with a different type or size of wire. To this end each of the dispensing heads is mounted in a pallet, diagrammatically illustrated at 45, and the individual pallets and their dispensing heads would be kept in a rack or other structure, not shown, on a side of the layout table or otherwise accessible by the translatory device, also not shown, would engage a selected pallet in which a head 28 is carried without interfering with the wire supply, which would be a spool of wire supported directly on the pallet rather than the remote wire supply indicated by FIG. 6. After the appropriate wires of that size are laid, the pallet is automatically exchanged for an assembly threaded with a different type of wire.

The guide member of the head comprises a vertical elongated rider which is journalled on the shaft 44 and retained by a clip 46. A portion of the guide member extends beneath the shaft and a strand or wire feed means, which actually dispenses wire onto the layout table, is mounted to this extended portion. Two different embodiments of the feed means are shown, both of which have a wire outlet which is disposed eccentrically of the rotational axis of the guide member, and a wire passageway defined between the hollow shaft 44 and the outlet.

Figure 1:
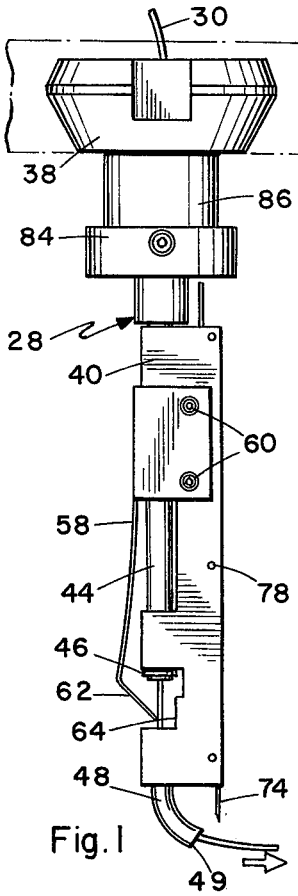
FIG. 1 is a side elevation view of the wire pay out unit.
Figure 2:
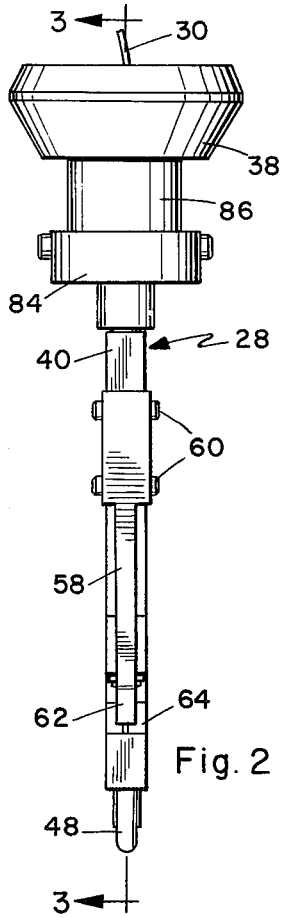
FIG. 2 is a view as taken from the left hand side of FIG. 2.
Figure 4:
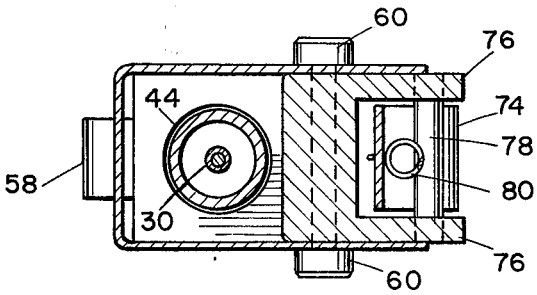
FIG. 4 is an enlarged sectional view taken on line 4—4 of FIG. 3.
Figure 5:
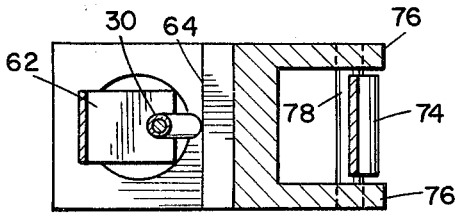
FIG. 5 is an enlarged sectional view taken on line 5—5 of FIG. 3.
Figure 3:
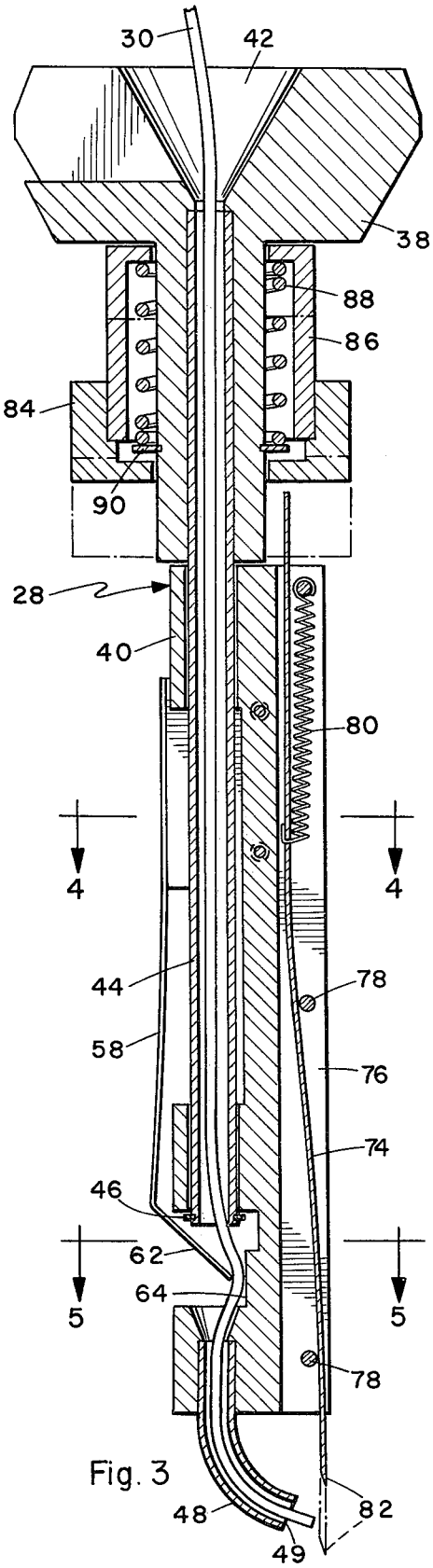
FIG. 3 is an enlarged sectional view taken on line 3—3 of FIG. 2.
Figure 14:
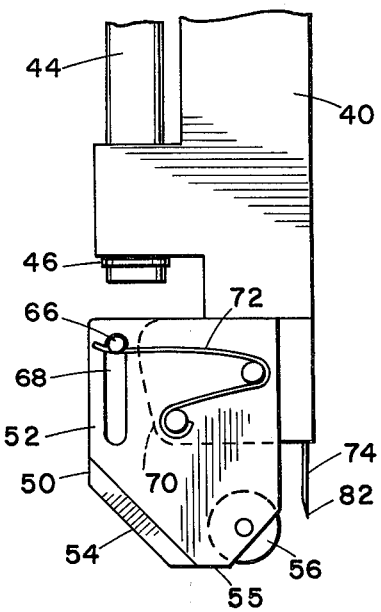
FIG. 14 is a side elevation view of an alternative wire feeding tip.
Figure 15:
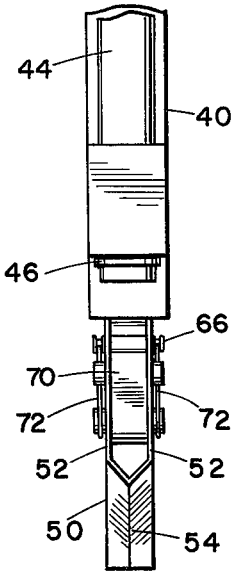
FIG. 15 is a front view of the tip as taken from the left hand side of FIG. 14.
Figure 16:
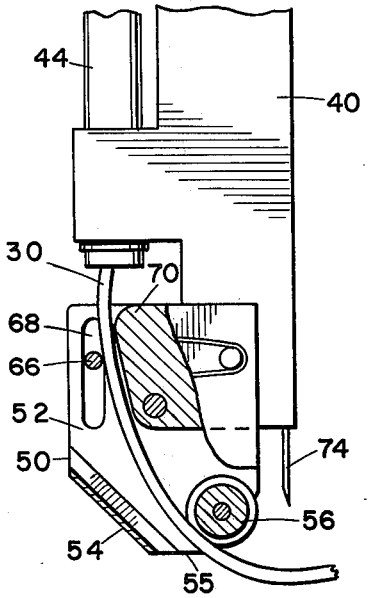
FIG. 16 is a side elevation view, similar to FIG. 14, partially cut away to show the wire feed action.

The first of these feed means, best illustrated in FIGS. 1–3, is simply a curved tube 48 having an outlet 49, and the second, variant form is a roller feed as is illustrated in FIGS. 14–16, comprising a pair of parallel walls 52 angled together at the front to form a bow-like leading edge 59 and having a roller 56 journalled between the trailing edges of the walls to define a wire outlet 55. The roller feed is slightly more suitable for dispensing heavier gauge wires than the tube feed.

As will be understood hereinafter, it is desirable for the proper functioning of the wire gripping combs that a catch means be provided to prevent loss of the protruding "tail" of wire due to reverse travel of the wire in the dispensing head, and the closer the catch is to the wire outlet the less significant will be the undesireable backlash caused by wire curl. Two catch means are shown, the first, best illustrated in FIGS. 1–3, comprising a resilient blade 58 secured to an upper portion of the guide means at 60 by any suitable means and having an inwardly bent tongue 62 biased toward a flat surface 64 of the guide across the path of the supply wire 30 so that upon tensioning of the wire, as would normally be the case when the dispensing head is traveling between combs, the tongue is ineffective as shown in FIG. 1, but upon the wire becoming slack, the tongue pinches the wire against the surface 64 and arrests is reverse travel.

The second catch is illustrated in FIGS. 14–16 and comprises a bearing element 66 which rides in slots 68 in the walls 52 such that the bearing path assumes an inclined angle relative to the planar face of a ramp element 70 which is part of the guide means. The bearing is biased into proximity with the ramp by means of springs 72 such that a wedging action occurs to prevent reverse wire travel as will be readily understood by reference to the drawings.

The trailing edge of the guide member 40 has attached thereto a vertically slideable knife 74 which is restrained in place between side walls 76 of the guide by pins 78 and is upwardly urged by a small coil spring 80 into an inoperative position, as best seen in FIG. 3. The cutting edge 82 of the knife is suspended just above the wire outlet and is lowered to sever the wire against an anvil surface, described hereinafter, by an annular hammer 84. The hammer is provided with a collar 86 which is upwardly biased by a coil spring 88 retained by a clip 90, and the downstroke is accomplished by an automatically controlled yoke or fork, not shown, which is operatively mounted on the translating device 32.

Turning now to the gripping elements 26, it can be seen that each of these members comprises a basic comb-like block 92 which is provided with open-topped parallel slots 94 through which the feed means is drawn. The slots are dimensioned to be slightly narrower than the width of the feed and the wire dispensed thereby, and the block 92 is of resilient material so that as the dispensing head passes through a slot the extending tip of wire is gripped by the slot walls and wire is drawn from the head as it moves away from the comb block. The slots 94 are preferably expanded into V-shaped notches 116 at their ends to guide the wire feed means into the slots.

Figure 8:
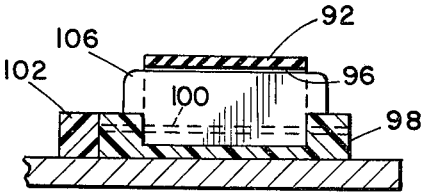
FIG. 8 is a sectional view taken on line 8—8 of FIG. 7.
Figure 9:
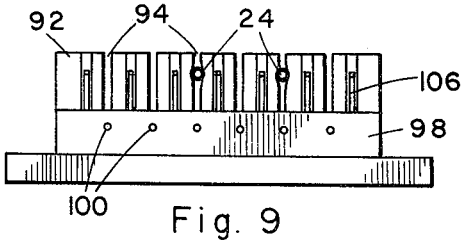
FIG. 9 is an end elevation view as taken from the right hand side of FIG. 8.
Figure 10:
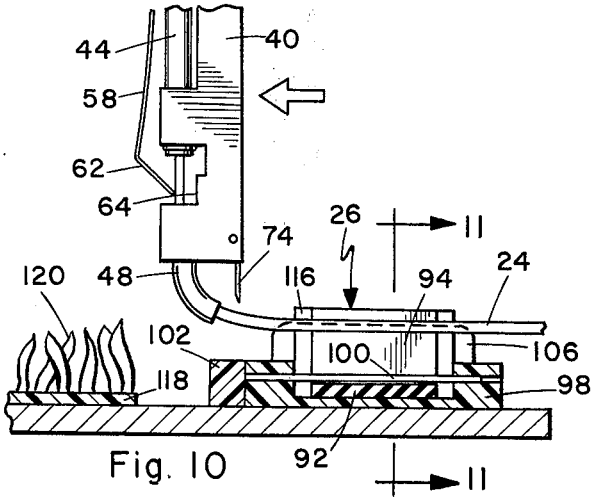
FIG. 10 is a sectional view taken on line 10—10 of FIG. 7 showing how a wire is engaged in the unit.
Figure 11:
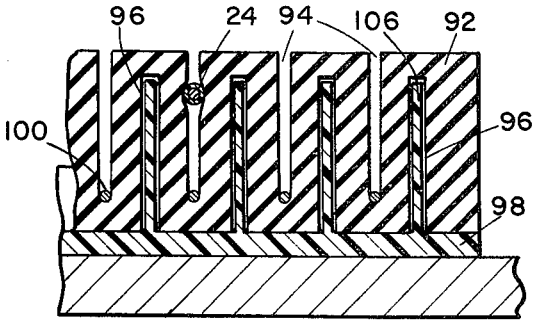
FIG. 11 is an enlarged sectional view taken on line 11—11 of FIG. 10.

Two somewhat different versions of the comb are shown, the first, being illustrated in FIGS. 9–11, having parallel upcut slots 96 interdigitated with the slots 94, the purpose of which is to permit expansion of the lower reaches of the walls of each individual one of the slots 94 without upsetting the precise lateral positioning of adjacent slots. The resilient comb blocks are removably retained in rigid nests 98 as best shown in FIG. 8, each nest having horizontal bores therethrough which are aligned with the bottoms of the slots 94, and a series of prongs 100 attached at one end to a bar 102 are inserted through these bores to retain the block. For further securement, parallel ribs 106 upstanding from the nest 98 loosely engage the upcut slots 96 to deter lateral displacement of the slots. It will be noted that the comb blocks 92 are removeable simply by sidewise withdrawal of the pronged bar 102.

Figure 12:
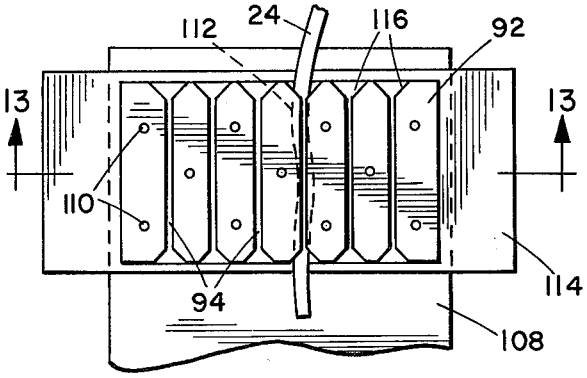
FIG. 12 is a top plan view of an alternative comb assembly.
Figure 13:
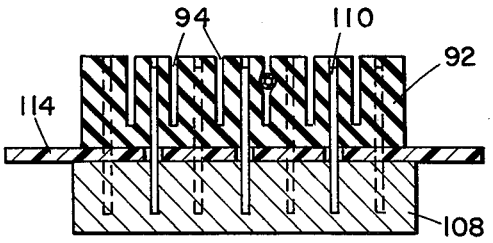
FIG. 13 is a sectional view taken on line 13—13 of FIG. 12.

In the second embodiment of the comb, illustrated in FIGS. 12 and 13, a mounting block 108 is secured to the layout board beneath each comb station and the comb block 92 is secured by a plurality of pegs 110 upstanding from the block and engaging mating bores in the comb. The pins are preferably staggered laterally of the slots as shown in FIG. 12 so that a length of wire captured in a slot will assume a slightly serpentine configuration as illustrated at 112 to increase the purchase of the wire by the comb.

It is desireable that the combs be removable so that they may be retained on the harness after it is complete to preserve the order of wire terminals and thus reduce or eliminate the necessity of color coding or otherwise identifying the wires. The combs may be retained with the harness until final installation is complete, or even left on the harness permanently, perhaps doubling as mounting blocks. To provide easy removal of the combs from the layout board assembly, a small rectangular panel 114 is disposed between each comb block and the accompanying mounting block and is of area dimension greater than the latter so that the edges thereof may be easily gripped by the fingers to snap the comb block free from the assembly. The panel is also of larger area dimension than the comb block so that it may be used as an anvil or chopping block for knife 74 when the wires are cut.

After a wire is cut, or prior to the initiation of a harness run, the feed means of the dispensing head will not necessarily be properly oriented for making a pass through a comb slot because there will be no tension on the wire. To properly orient the feed, patches of material 118 having resilient fingerlike projections 120 as best shown in FIG. 10, may be attached to the layout board behind each comb so that by entering the comb from the patch side, the feed means will be drawn through the projections and aligned parallel with the slot to be entered. Astroturf or similar artificial grass material has been found quite suitable for this purpose.

An alternative and perhaps preferable means of aligning the feed, which is not illustrated, would be to provide the translating device with electromagnets adjacent the yoke used to grip the dispensing head.

Complimenting these magnets on the base 38 of the head would be soft iron induction bars which would coact in an attractive or repulsive manner with permanent magents mounted on the guide means so that the feed orientation could be controlled from the translating device by controlling the polarity of the electromagnets with no physical power linkage required between the dispensing head and the gripping structure on the translatory device.

I claim:

1. A harness making assembly comprising:

a strand dispensing head having a base and a guide member rotatably mounted on the base;

a strand feed means mounted on said guide member and defining a strand passageway having a strand outlet disposed eccentrically of the rotational axis of said guide member;

means of supplying a strand to said guide member;

means for translating said dispensing head sequentially to a plurality of spaced stations;

a plurality of strand retaining elements supported at a plurality of said stations; and said strand retaining elements each comprise a block of resilient material having at least one strand receiving slot therethrough structured to permit the passage therethrough of said feed means and grip a strand projecting from said outlet.

2. Structure according to claim 1 and including cutting means mounted on said dispensing head and extendable across said outlet in spaced relation thereto to cut a strand extending therefrom, and retractable clear of said outlet subsequent to cutting to leave an extended strand end free to be engaged by a strand-receiving slot.

3. Structure according to claim 2 wherein said cutting means comprises a knife slideably mounted on said guide member such that the edge thereof is displaceable across the path of a wire extending from said strand passageway and including a plurality of hard surfaced elements supported adjacent said retaining elements to serve as anvils for said knife.

4. Structure according to claim 1 and including a catch mounted on said dispensing head for gripping a reverse-traveling strand to prevent the reverse travel thereof in said passageway, and permitting a strand being dispensed to pass substantially unhindered in the dispensing direction.

5. Structure according to claim 4 wherein said catch comprises a resilient blade mounted on said guide member and biased against a surface thereof to permit the travel of a strand threaded between said blade and said surface upon the tensioning of such a threaded strand and gripping same upon the slackening thereof.

6. Structure according to claim 4 wherein said catch comprises a ramp member mounted in said guide member and having a planar surface, and a bearing element mounted in said guide member and displaceable therein along a path which is inclined relative to said planar surface, and including means biasing said bearing element along said path into the position nearest to said planar surface, whereby a strand threaded between said ramp member and said bearing is freely displaceable in one axial direction and subject to pinching action of said bearing and said ramp member upon being displaced in the other axial direction.

7. Structure according to claim 1 wherein said feed means includes wall members defining a corridor and a guide roller adjacent said outlet and having an annular groove in the perimeter thereof, whereby a strand can be threaded through said corridor and outlet in contact with said grooved roller.

8. Structure according to claim 1 wherein said block has a plurality of upwardly open, parallel strand-receiving slots therein and including a second plurality of downwardly open slots interdigitated with said strand receiving slots to permit the expansion of said strand-receiving slots.

9. Structure according to claim 1 and including a layout board, said blocks being mounted to said layout board, and including a plurality of clusters of upwardly extended resilient finger-like projections mounted on said board adjacent said blocks of utility in properly orienting said guide member on said base relative to the adjacent slotted block.

10. Structure according to claim 1 wherein each of said resilient blocks is provided with a plurality of parallel bores between said slots, said bores being staggered laterally of the slots, and including a rigid member for each block having a plurality of posts extending therefrom into said bores on the side of the block remote from the slot openings to restrain said block from movement.

11. Structure according to claim 10 and including a layout board, said rigid members being blocks and including a panel for each rigid block and separating same from the respective resilient block, each of said panels being apertured to loosely receive said posts and having portions thereof overlapping said rigid blocks to permit easy removal of said resilient blocks.

12. Structure according to claim 1 wherein said strand dispensing head is one of a plurality of strand dispensing heads selectively engageable for translatory motion by said translating means, whereby a plurality of wire types can be dispensed without requiring rethreading of a strand dispensing head.

* * * * *